US006070265A

United States Patent [19]

Tasbas

[11] Patent Number: 6,070,265

[45] Date of Patent: Jun. 6, 2000

[54] NOSE WARMER

[76] Inventor: Hedy T. Tasbas, 8 Chesham Way, Fairport, N.Y. 14450

[21] Appl. No.: 09/285,594

[22] Filed: Apr. 3, 1999

[51] Int. Cl.[7] ..... A41D 13/00

[52] U.S. Cl. ..... 2/9; 2/206; 128/858

[58] Field of Search ..... 2/9, 206, 410; 128/206.21, 858; 602/74; D24/110.1

[56] References Cited

U.S. PATENT DOCUMENTS

| | | | |
|---|---|---|---|
| 364,733 | 6/1887 | Sentman | 2/206 |
| 601,401 | 3/1898 | Praeckel | 2/206 |
| 1,070,584 | 8/1913 | Byron | 2/206 |
| 3,220,409 | 11/1965 | Liloia et al. | 2/206 |
| 5,035,006 | 7/1991 | Hetz et al. | 2/209.1 |
| 5,697,105 | 12/1997 | White | 2/206 |

*Primary Examiner*—Diana Oleksa
*Assistant Examiner*—Katherine M. Moran
*Attorney, Agent, or Firm*—Howard J. Greenwald

[57] ABSTRACT

A apparatus for warning a person's nose which is made from porous fleece fabric and contains a cup portion attached to two straps, each of which are then attached to each other. The straps have a width of at least about 1.0 inch, and an elastic band is connected to the inner surface of each of the straps. Each of the elastic bands extends from about 50 to about 95 percent of the length of the inner surface of the strap but does not extend to the ends of such inner surface.

9 Claims, 1 Drawing Sheet

NOSE WARMER

FIELD OF THE INVENTION

A article for protecting a person's nose from the elements which is made from fleece.

BACKGROUND OF THE INVENTION

Devices for protecting portions of the human body which are exposed to the elements, such as rain, wind, and sunshine, are well known. Thus, for example, U.S. Pat. No. 3,594,813 of Sanderson discloses an elastomeric protective device containing an adhesive for securing it to a person's nose. Thus, e.g., U.S. Pat. No. 1,319,273 of Dobey discloses a mask with a frame made of "cross wires" which are covered with gauze. Thus, e.g., U.S. Pat. No. 5,003,633 of Itoh discloses a seal device for a face protector which is made of a material which is rigid at ambient temperature.

None of the prior art devices is both flexible, comfortable, and sufficiently warm. It is an object of this invention to provide a device for protecting the human nose from the elements which will be securely retained about a wearer's nose, which is comfortable, which is warm, and which may be configured to allow a user to breath freely while wearing it.

SUMMARY OF THE INVENTION

An apparatus for warming a person's nose comprised of an integral cup consisting essentially of fleece, a fleece strap connected to said integral cup, a first elastic band connected to one portion of said fleece strap, and a second elastic band connected to a second portion of said fleece strap.

BRIEF DESCRIPTION OF THE DRAWINGS

The invention will be described by reference to the following drawings, in which like elements are disclosed by like numerals, and in which.

DESCRIPTION OF THE PREFERRED EMBODIMENTS

Figure 1:
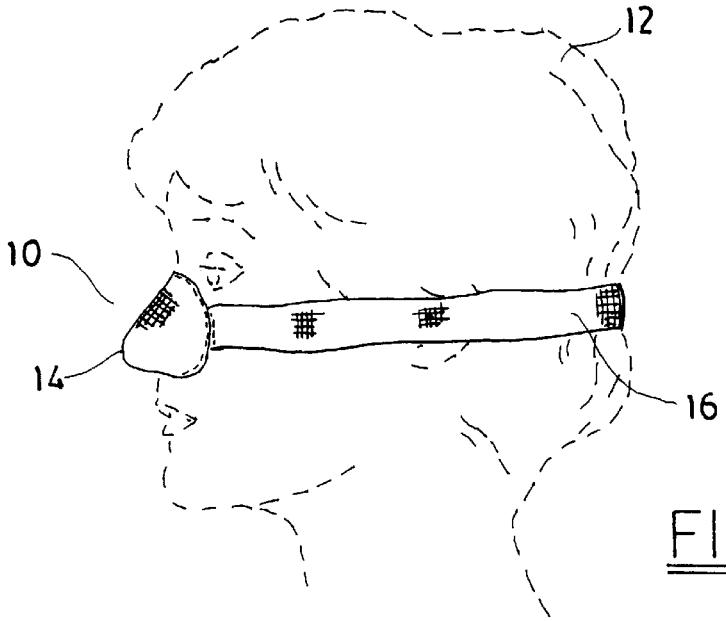
FIG. 1 is a side view of a person wearing a preferred nose warmer of this invention.

Figure illustrates how one preferred nose warmer 10 is disposed upon a person 12's face. It will be seen that the nose warmer 10 depicted in FIG. 1 is comprised of a cup 14 connected to a first strap 16.

Figure 2:
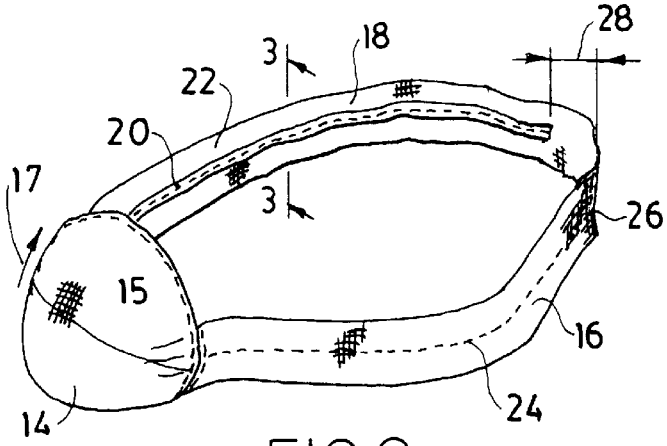
FIG. 2 is a perspective view of the nose warmer of FIG. 1.
Figure 3:
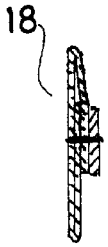
FIG. 3 is a sectional view of the nose warmer of FIG. 2, taken through lines 3—3.

FIG. 2 is a perspective view of the nose warmer 10, from which it will be seen that nose warmer 10 also is comprised of a second strap 18, a first elastic band 20 connected to the inner surface 22 of second strap 18, and a second elastic band (not shown) similarly attached to the inner surface (not shown) of first strap 16. In the preferred embodiment depicted, the elastic bands are sewn to the straps; what is shown in FIG. 2, however, are the stitches 24 used to connect the second elastic band (not shown) to the inner surface of the first strap 16.

Referring again to FIGS. 1 and 2, and in the preferred embodiment depicted therein, cup 14 consists essentially of fleece. As used herein, the term fleece refers to a fabric made from wool of a sheep.

As is known to those skilled in the art, fleece is generally porous and, thus, has the property of breathability. With such property, cup 14 does not trap moisture in it when contacted with air from the user's nose. If it did, moisture trapped in it would reduce its insulating ability and make the wearer's nose cold.

Thus, the cup 14 preferably consists essentially of porous fleece fabric. These porous fleece fabrics are well known and are described, e.g., in German patent 38 16 015, U.S. Pat. Nos. 3,687,759, 3,691,004, 4,843,648, 5,013,382, 5,062,838, 5,194,296, 5,686,090, 5,740,634, 5,814,569, 5,820,888, and the like. The disclosure of each of these United States patents is hereby incorporated by reference into this specification.

In one preferred embodiment, the porous fleece fabric used in porous polar fleece fabric. Polar fleece fabric is described, e.g., in U.S. Pat. Nos. 5,884,419, 5,884,336, 5,881,390, 5,875,493, 5,865,180, 5,862,523, 5,784,806, 5,756,180, 5,678,325, 5,603,646, 5,553,399, 5,535,449, 5,246,154, 5,150,536, 5,047,001, and the like. The entire disclosure of each of these United States patents is hereby incorporated by reference into this specification.

Figure 4:
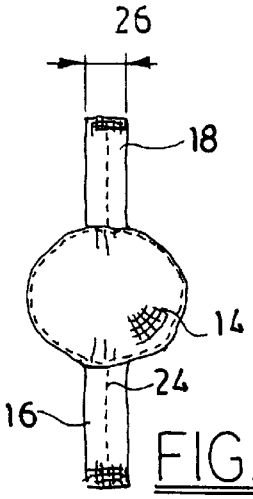
FIG. 4 is a front view of the nose warmer of FIG. 2.
Figure 5:
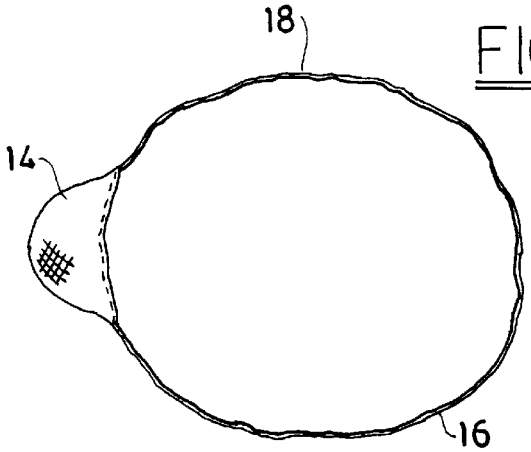
FIG. 5 is a top view of the nose warmer of FIG. 2.

Referring again to FIG. 2, and in the preferred embodiment depicted therein, it will be seen that straps 16 and 18 also preferably consist essentially of fleece fabric. As will be seen by reference to FIG. 4, each of straps 16 and 18 preferably has a width 26 of at least about 1.0 inch and, more preferably, at least about 1.3 inches. Without wishing to be bound to any particular theory, applicant believes that this minimum width insures that a person may comfortably wear the nose warmer 10 for extended periods of time while insuring that both his nose and his cheek area stay adequately warm. Furthermore, this minimum width also tends to keep the wearer's ears warm.

As is illustrated in the Figures, each of the straps 16 and 18 may be joined to each other (at, e.g., point 26 of FIG. 2) and/or to the cup 14 by conventional means, such as sewing. Each of straps 16 and 18 also preferably has attached to it by, e.g., sewn stitches, a length of elastic material such as, e.g., elastic material 20. The elastic material is disposed at essentially the center of the inner surface of each strap, and it extends from about 50 to about 95 percent of the length of the strap. It is essential that a space 28 be left between each end of the elastic material 20 and the juncture at which the strap is connected either to another strap and/or to the cup 14. This structural feature insures comfort for the wearer at both the back of a wearer's head and near a wearer's nose on both sides.

Referring to FIG. 2, the fact that cup 14 is made from a porous fleece fabric not only affords it breathability but also flexibility. Thus, e.g., a wearer while using device 10 might fold up the cup portion 14 along line 15 in the direction of arrow 17 to expose a portion of his nose to the elements and to allow himself to more readily breath.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. A apparatus for warming a person's nose comprising a integral cup consisting essentially of porous fleece fabric, a first strap connected to said integral cup, and a second strap connected to said integral cup and to said first strap, wherein:

(a) each of said first strap and said second strap has a width of at least about 1 inch and consists essentially of said fleece fabric, (b) said first strap is comprised of a first inner surface comprised of a first end and a second end, and a first outer surface, (c) said second strap is comprised of a second inner surface comprised of a third end and a fourth end, and a second outer surface, (d) a first elastic band disposed on and connected to said first inner surface, wherein said first elastic band extends from about 50 to about 95 percent of the length of said first inner surface but does not extend to either said first end or said second end of of said first inner surface, and (e) a second elastic band disposed on and connected to said second inner surface, wherein said second elastic band extends from about 50 to about 95 percent of the length of said second inner surface but does not extend to either said third end or said fourth end of said second inner surface.

2. The apparatus as recited in claim 1, wherein said integral cup consists essentially of polar fleece fabric.

3. The apparatus as recited in claim 2, wherein said first strap consists essentially of polar fleece fabric.

4. The apparatus as recited in claim 3, wherein said second strap consists essentially of polar fleece fabric.

5. The apparatus as recited in claim 4, wherein said first strap is connected to said integral cup by stitches.

6. The apparatus as recited in claim 5, wherein said second strap is connected to said integral cup by stitches.

7. The apparatus as recited in claim 6, wherein said first strap is connected to said second strap by stitches.

8. The apparatus as recited in claim 7, wherein said first strap has a width of at least about 1.3 inches.

9. The apparatus as recited in claim 8, wherein said second strap has a width of at least about 1.3 inches.

* * * * *